US006338565B1

(12) United States Patent
Fager et al.

(10) Patent No.: US 6,338,565 B1
(45) Date of Patent: Jan. 15, 2002

(54) DEVICE IN A LIGHT FITTING

(75) Inventors: Stefan Fager, Mjolby; Stefan Fullmestad, Linkoping, both of (SE)

(73) Assignee: Locklight AB, Linkoping (SE)

( * ) Notice: Subject to any disclaimer, the term of this patent is extended or adjusted under 35 U.S.C. 154(b) by 0 days.

(21) Appl. No.: 09/491,918

(22) Filed: Jan. 27, 2000

Related U.S. Application Data

(63) Continuation of application No. PCT/SE98/01421, filed on Jul. 30, 1998.

(30) Foreign Application Priority Data

Jul. 30, 1997 (SE) ..... 9702825

(51) Int. Cl.[7] ..... F21V 17/00
(52) U.S. Cl. ..... 362/363; 362/311
(58) Field of Search ..... 362/311, 363

(56) References Cited

U.S. PATENT DOCUMENTS 1,029,356 A 6/1912 Frederick
5,499,174 A * 3/1996 Lin ..... 362/363 X
5,560,707 A 10/1996 Neer ..... 362/376
5,868,490 A * 2/1999 Barthelmess ..... 362/363 X
5,980,072 A * 11/1999 Zirkle ..... 362/363 X
6,010,236 A * 1/2000 Lai ..... 362/363 X

* cited by examiner

*Primary Examiner*—Laura K. Tso
(74) *Attorney, Agent, or Firm*—Altera Law Group, LLC

(57) ABSTRACT

The present invention relates to a device in a light fitting comprising a bulb and a cover (1*a*) surrounding the bulb, together with a socket (2) that can be functionally joined thereto by way of a connecting piece (1*b*) of the cover. The device is characterised in that a first part (7) insertable into the socket (2) is formed with at least one element (10), adapted to allow the first part (7) to be connected to the socket (2), so that it can be turned in relation to the socket (2) whilst at the same time being locked thereto in an axial direction. The first part (7), moreover, incorporates at least one catch element (11), adapted on the one hand to allow the first part (7) to be fixed to the cover and on the other to allow the fixing to be undone by means of tool specially intended for this purpose, whereupon the cover (1), can be separated from the first part (7), for example for changing bulbs.

12 Claims, 3 Drawing Sheets

DEVICE IN A LIGHT FITTING

This is a continuation of PCT/SE98/01421 filed Jul. 30, 1998.

BACKGROUND OF THE INVENTION

1. Field of the Invention

The present invention relates to a device in a light fitting of the type that comprises a bulb, a cover surrounding the bulb, and a light socket.

2. Brief Description of the Prior Art

Enclosing a lamp arranged on a wall with a surrounding cover that is fixed to the wall by way of a socket is already known in the art. The conventional method of connecting the cover to the socket is by screwing in a threaded connecting piece on the cover into a corresponding thread in the socket. The increasing use of energy-saving light bulbs, involving a relatively high cost compared to conventional light bulbs, has meant that removing the cover from the socket in order to steal the thereby accessible bulb and possibly also the cover has become increasingly common.

SUMMARY OF THE INVENTION

According to one embodiment of the present invention there is provided a device in a light fitting comprising a bulb and a cover surrounding the bulb, together with a socket. The device is functionally connectable to the cover by way of a connecting piece of the cover, the device comprising a first part insertable into the socket and formed with at least one element adapted to allow the first part to be connected to the socket, so that it can be turned in relation to the socket while at the same time being locked thereto in an axial direction. The first part is releasably fixed to the cover and can be released by means of a special tool insertable into a tool access.

Preferred embodiments of the present invention furthermore have additional features and characteristics The device according to the invention has several advantages. It makes removal of the cover from the socket and hence theft of the bulb and/or the cover considerably more difficult, whilst being relatively cheap, and it can, if so required, be used together with conventional covers/sockets.

BRIEF DESCRIPTION OF THE DRAWINGS

The present invention will be further explained below with reference to the drawings attached, illustrating examples of designs according to the invention, in which:

In FIG. 1, 1 generally denotes a cover, which comprises a globe 1 a of a translucent material and a connecting piece 1*b*, the connecting piece 1*b* having an external thread. In addition, a socket 2, which may, for example, be mounted on a wall, has a corresponding internal thread. The cover 1 and the socket 2 together form a light fitting in which the cover 1, by means of the threads, can be screwed fast to the socket 2 in a conventional manner so that it encloses a bulb (not shown), for example an energy-saving bulb, connected to a lamp socket 3.

Figure 1:
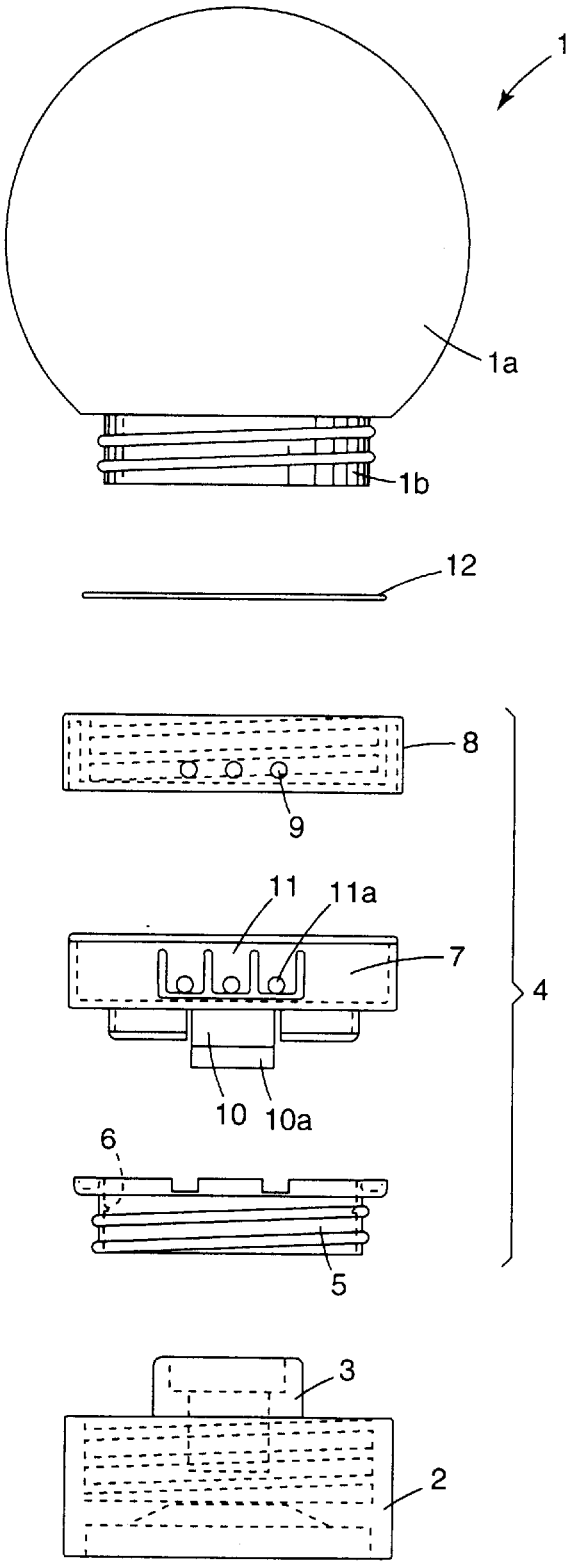
FIG. 1 is an exploded view showing the parts in a device according to a first embodiment of the present invention.

A device 4 for preventing misappropriation of the energy-saving bulb from the light fitting can be fitted between the cover 1 and the socket 2. In this example the device 4 comprises an essentially annular part 5, connectable to the socket 2 and provided with an external thread, which corresponds to the internal thread of the socket, allowing the annular part 5 to be screwed together with the socket 2. The annular part 5 is provided internally with a flange 6 directed radially inwards. A first part 7 can additionally be inserted into the annular part 5. Furthermore a third part 8, provided with openings 9, can be connected to the connecting piece 1*b* of the cover in that it has an internal thread corresponding to the external thread of the said connecting piece. The design of the parts 5, 7 and 8 will be more clearly seen from FIG. 2 and will therefore be described further in connection with that figure.

Figure 2:
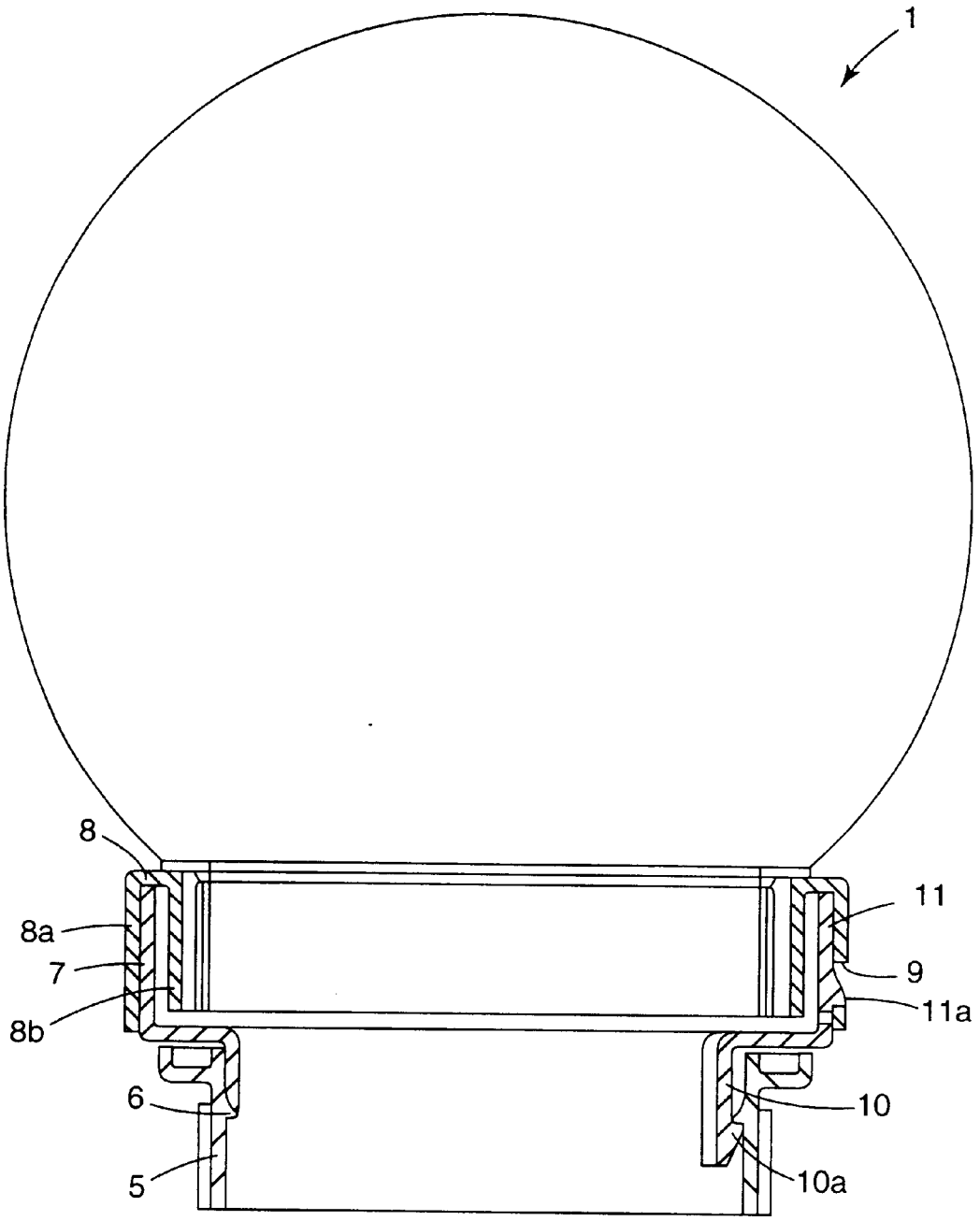
FIG. 2 shows diagrammatically through a section how the parts in the device in FIG. 1 are assembled.

FIG. 2, which illustrates certain details of the parts 5, 7 and 8, shows that the first part 7 has at least one element 10, which is adapted to grip around the flange 6 of the annular part 5 (the threads on the annular part 5 are not shown in this figure). In this example the element 10 is a resilient tongue, which is displaceable in a radial direction and functions in such a way that, when the first part 7 is inserted into the annular part 5, the element 10 is forcibly displaced in the resilient direction whereupon, once the flange 6 has been passed, a book 10*a* on the element 10 is adapted to snap in and grip around the flange 6. In this position the first part 7 can be freely turned in relation to the annular part 5, whilst at the same time being locked to this in an axial direction. Because the diameter of the upper portion of first part 7 is greater than the diameter of the annular part 5 and the first part 7 thereby covers the annular part 5, this part is not accessible from the outside, for which reason the annular part 5 cannot be screwed out of the socket 2 when the device is fitted.

Moreover radially and resiliently displaceable catch elements 11 are formed in the first part 7, which in this example are designed as resilient tongues that, by means of locking heels 1*a* arranged on the latter, are adapted to engage in openings 9 arranged in the third part 8 in order to fix the first part 7 to the third part 8. This fixing is the final step in fitting the device 4 to the light fitting and is thus performed once the parts 5 and 7 have been fitted on the socket 2 and once the third part 8 has been fitted to the cover 1. The openings 9, as can clearly be seen from FIGS. 1 and 2, are formed in an outer cover 8*a* of the third part 8, and the first part 7 is adapted to be inserted into an intervening space between the outer cover 8*a* and an inner wall 8*b* of the third part 8, on the inside of the inner wall 8*b* of which the internal threads (not shown in FIG. 2) are arranged. In the same way as the element 10, the catch elements 11, on insertion of the first part 7 into the third part 8, are pressed in their resilient direction until the locking heels 11*a* snap into the hole 9, thereby producing snap locking. The first part 7 is now locked relative to the third part 8. In order for the elements 10, 11 to be able to function as intended, they should be made of a hard, rigid but tough material, for example acetal plastics (POM), as should also the rest of the first part 7 in one individual embodiment.

Because of the interaction between the annular flange 6 and the gripping element 10, turning the cover 1 when the device is fitted merely results in this being turned in relation to the annular part 5. Because the third part 8 is made externally very smooth when the device is fitted, it is virtually futile to try to manually force this part in order to screw the cover out of the third part 8.

The fixing between the parts 7 and 8 can be undone, but without a special tool made for the purpose it is very difficult to achieve. The special tool has projecting sections corresponding to the openings, by means of which the locking heels 11*a* on the catch elements 11 can be simultaneously displaced in the resilient direction when the special tool is pressed against the openings. It will be perceived that by varying the number and placing of the interacting holes 9 and the locking heels 11*a* of the catch elements 11*a* very large number of different locking geometries can be produced. Since all locking heels 11 a on the catch elements 11 can be pressed in simultaneously by using a special tool, the first part 7 can be released from the third part 8, as a result of which the cover can be separated from the socket. It is then easy to get at the bulb enclosed by the cover, in order to change the bulb, for example. In this position, when the fixing is undone it is possible to dismantle the entire device. The tool can also be provided with means of displacing the element 10 in the resilient direction so that the hook 10*a* can be made to release the flange 6, in order, where necessary, to facilitate dismantling of the first part 7.

FIG. 1 shows that in one embodiment a sealing ring 12, preferably of rubber, can be arranged between the third part 8 and the connecting piece 1*b* of the cover in order to produce sealing between these parts.

Figure 3:
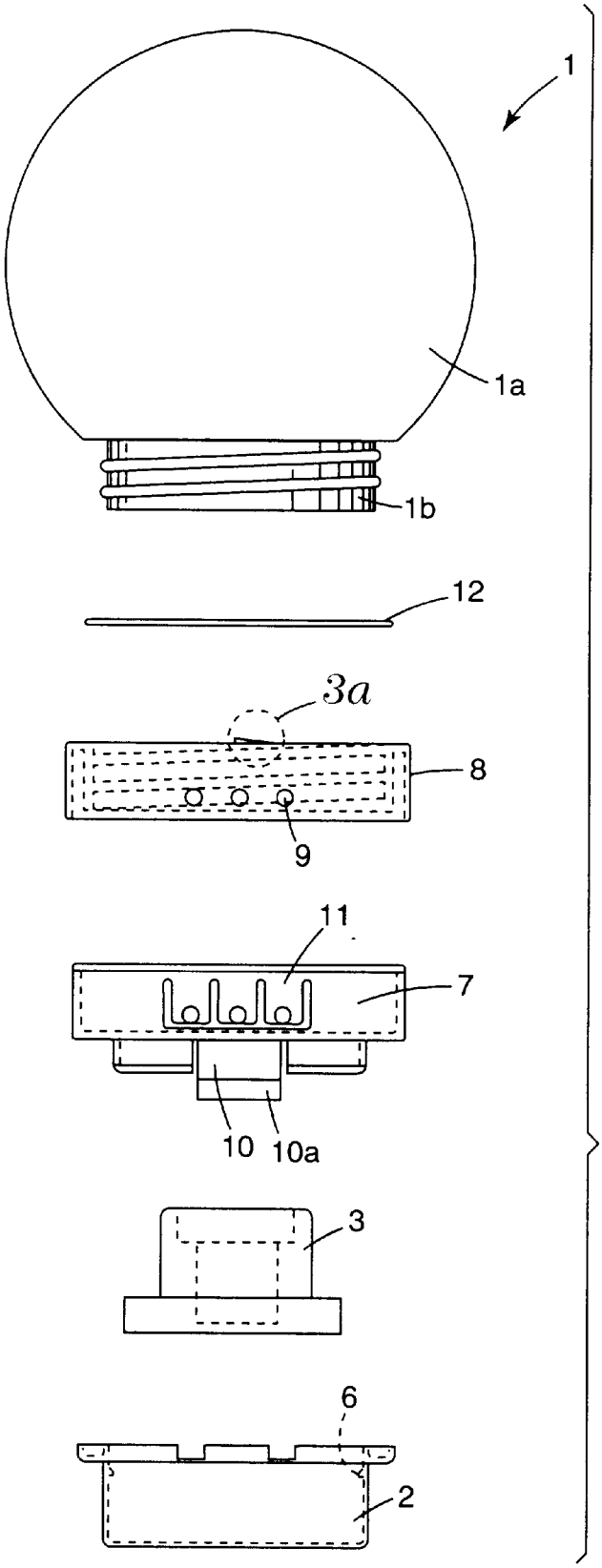
FIG. 3 is an exploded view showing the parts in a device according to a second embodiment of the present invention.
Figure 3A:
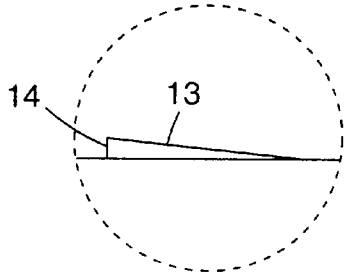

In FIG. 3, as in FIG. 1, 1 generally denotes a cover, comprising a globe Ia and a connecting piece 1*b*, in which the connecting piece 1*b* has an external thread. A socket 2, which may, for example, be mounted on a wall, has inside it an annular flange 6 directed radially inwards. Thus the cover 1 cannot be fitted directly to the socket, but rather requires some intermediate device. The cover 1 is designed to enclose a bulb connected to a bulb socket 3, preferably an energy-saving bulb (not shown).

A first part 7, which is formed as described in connection with FIGS. 1 and 2, can be inserted into the socket 2. Furthermore, as described in connection with FIG. 1 and 2, yet a third part 8, provided with openings 9, can be fitted to the cover 1 by means of an internal thread.

As in FIG. 1, a sealing ring 12, preferably of rubber, can be arranged between the third part 8 and the connecting piece 1*b* of the cover in order to produce sealing between the said parts. In this embodiment at least one cotter 13 is arranged on that side of the third part 8 corresponding to the cover. The effect of this is that, when the third part 8 is screwed on to the connecting piece of the cover, the cotter presses into the sealing ring and is surrounded by the latter. Screwing the third part 8 out of the cover then becomes difficult, not to say impossible, since the back edge 14 of the cotter 13 prevents screwing in the opposite direction.

The invention is naturally not limited to the embodiments mentioned above by way of examples but lends itself to modifications within the framework of the idea of the invention defined in the following claims. It is possible, for example, to form openings 9 directly in the cover connecting piece 1*b*, which then does not need to be provided with any external thread, but can be connected directly to the first part 7. Moreover, the connection of the first part 7 to the annular part 5, so that the first part 7 can be turned freely in relation to the annular part 5 whilst at the same time being locked thereto in an axial direction, can be achieved by providing the first part 7 with a threaded connecting piece, the threads of which correspond to a thread arranged in the annular part 5 that is designed in such a way that, after assembly in the annular part 5, a free fit is obtained for the thread on the connecting piece of the first part 7.

What is claimed is:

1. A device in a light fitting comprising a bulb and a cover surrounding the bulb, together with a socket, said device functionally connectable to the cover by way of a connecting piece of the cover, said device comprising a first part insertable into the socket and formed with at least one element adapted to allow the first part to be connected to the socket, so that it can be turned in relation to the socket while at the same time being locked thereto in an axial direction, and wherein:

at least one catch element is formed in the first part;

a tool access is provided on the first part;

said catch element is adapted to allow the first part to be releasably connected to the cover and to allow for release of the first part from the cover by means of a special tool insertable in said tool access; whereby the cover can be separated from the first part.

2. The device according to claim 1, wherein the element comprises a hook, arranged on a radially and resiliently displaceable tongue, the hook being adapted to grip around a circumferential edge, directed radially inwards, on the inside of the socket.

3. The device according to claim 2, wherein the edge and the socket are integrally formed.

4. The device according to claim 2, wherein the socket has an internal thread and that a second, essentially annular part with an external thread corresponding to the socket thread comprises an annular flange directed radially inwards so that the socket and the second part can be connected, the flange of the second part, directed radially inwards, being adapted to produce the circumferential edge, directed radially inwards, formed on the inside of the socket.

5. The device according to claim 1, wherein the catch element comprises a locking heel, arranged on a radially and resiliently displaceable tongue, the locking heel being adapted to engage in an opening arranged in a connecting piece of the cover corresponding thereto.

6. The device according to claim 5, wherein the opening is formed in the connecting piece of the cover.

7. The device according to claim 1, wherein:

the connecting piece of the cover comprises an external thread; and said device further comprises a third part provided with a corresponding internal thread and having at least one opening therein, the third part adapted to be threadably connected to the connecting piece, the opening in the third part aligned with the corresponding locking heel on the catch element.

8. The device according to claim 7, wherein a sealing ring, preferably of rubber, is adapted to produce a seal between the connecting piece of the cover and the third part.

9. The device according to claim 8, wherein:

at least one cotter, which is adapted to prevent the third part and the connecting piece of the cover being unscrewed, is arranged on the side of the third part corresponding to the connecting piece of the cover; and the cotter is adapted to press into the sealing ring when the third part is screwed on to the connecting piece of the cover and thereafter to catch against the sealing ring and prevent unscrewing.

10. The device according to claim 5, wherein:

said catch element comprises a plurality of said locking heels;

said connecting piece has a plurality of said openings formed therein; and the special tool is adapted to cause all locking heels to simultaneously leave their respective corresponding openings.

11. The device according to the claim 7, wherein:

said catch element comprises a plurality of said locking heels;

said connecting piece has a plurality of said openings formed therein; and the special tool is adapted to cause all locking heels to simultaneously leave their respective corresponding openings.

12. A device in a light fitting comprising a bulb and a cover surrounding the bulb, together with a socket, the device being functionally connectable to the cover by way of a connecting piece of the cover, the device comprising a first part insertable into the socket, said first part formed with at least one element adapted to allow the first part to be connected to the socket with the first part being free to turn in relation to the socket while at the same time being locked thereto in an axial direction, the first part being releasably fixed to the cover and released therefrom by means of a special tool insertable in a tool access.

* * * * *